United States Patent [19]

Crespin

[11] 4,456,431

[45] Jun. 26, 1984

[54] AXIAL VENTILATOR WITH PROTECTED BLADES

[75] Inventor: M. Joël Crespin, La Verpillere, France

[73] Assignee: L'Unite Hermetique, La Verpillere, France

[21] Appl. No.: 311,187

[22] Filed: Oct. 14, 1981

[30] Foreign Application Priority Data

Oct. 17, 1980 [FR] France ..... 80 22273

[51] Int. Cl.[3] ..... F04D 29/40

[52] U.S. Cl. ..... 416/189; 416/236 A; 416/247 R

[58] Field of Search ..... 416/247 R, 247 A, 189, 416/192, 236 A, 194, 196 G; 415/121 G

[56] References Cited

U.S. PATENT DOCUMENTS

| | | | |
|---|---|---|---|
| 1,072,189 | 9/1913 | Sparks | 416/189 R |
| 2,091,677 | 8/1937 | Fredricks | 416/236 A |
| 2,791,373 | 5/1957 | Wilcox | 416/247 R |
| 3,261,544 | 7/1966 | Guichard | 416/247 R X |

FOREIGN PATENT DOCUMENTS

| | | | |
|---|---|---|---|
| 1628375 | 8/1970 | Fed. Rep. of Germany | 416/189 |
| 2345539 | 3/1975 | Fed. Rep. of Germany | 416/247 R |
| 833938 | 5/1960 | United Kingdom | 416/247 R |

*Primary Examiner*—Stephen Marcus
*Assistant Examiner*—Joseph M. Pitko
*Attorney, Agent, or Firm*—Oblon, Fisher, Spivak, McClelland & Maier

[57] ABSTRACT

A ventilator according to the invention comprises at least two blades fixed to a hub adapted to be made integral with a motor shaft, a protection grille integral with said hub, protecting the front of the ventilator and being extended on the periphery of the ventilator by an annular casing assuring the protection of the radial ends of the blades.

11 Claims, 5 Drawing Figures

AXIAL VENTILATOR WITH PROTECTED BLADES

BACKGROUND OF THE INVENTION

The present invention relates to an axial ventilator provided with a means for frontal and radial protection.

Its aim is to prevent an accidental, dangerous contact with the ventilator blades.

Helical ventilators are known where the need to render non-dangerous accidental contacts from the outside has led to the use of blades made of flexible material. However, in general it is difficult to attain good aerodynamic characteristics by providing blades of a material which is sufficiently flexible to render an impact therewith non-dangerous.

Another solution currently adopted consists in utilizing rigid blades which rotate inside a fixeed protective grille, the openings of which let the air pass through. Such a protective grille is costly and increases the volume and the weight of the ventilator assembly considerably.

SUMMARY OF THE INVENTION

It is an object of the present invention to provide an axial ventilator which is less bulky, is of low cost, has good areodynamic characteristics and comprises a frontal and radical protection means which prevents the introduction of foreign objects between the ventilator blades.

According to the invention, an axial ventilator comprises: a hub holding the blades, which hub has a central hole for the passage of the motor shaft; and a protection device consisting of a frontal protective grille for the blades and an annular casing for radial protection, which casing is integral with the grille, is coaxial with the motor shaft and surrounds the radial ends of the blades, said ventilator blade comprising a protection device which is integral with the hub of the ventilator. The frontal protective grill is formed of a plurality of concentric rings which are coaxial with the motor shaft and disposed sufficiently close together to reduce the gaps between the rings in such a manner as to prevent foreign bodies from penetrating the gaps.

Another object of the invention is to provide, by molding and in one piece, the protection device according to the invention, i.e. the means which allow making the frontal protective grille integral with the hub.

Another object of the invention is the manufacturing in one piece of the protection device by molding of a plastic material.

Still another object of the invention is the manufacturing, by molding and in a single block, of the axial and radial protection device of the hub and the ventilator blades.

BRIEF DESCRIPTION OF THE DRAWINGS

The invention can be better understood and other features clarified by referring to the following description and accompanying drawings, wherein.

DETAILED DESCRIPTION OF PREFERRED EMBODIMENTS

Figure 1:
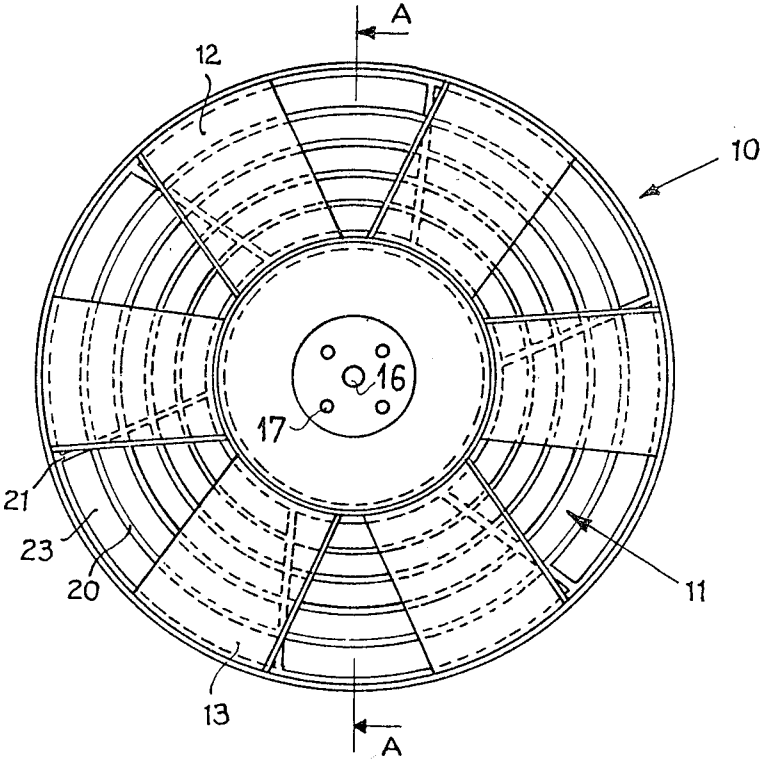
FIG. 1 is a view in elevation of an embodiment of the protection device for axial ventilators according to the invention.
Figure 2:
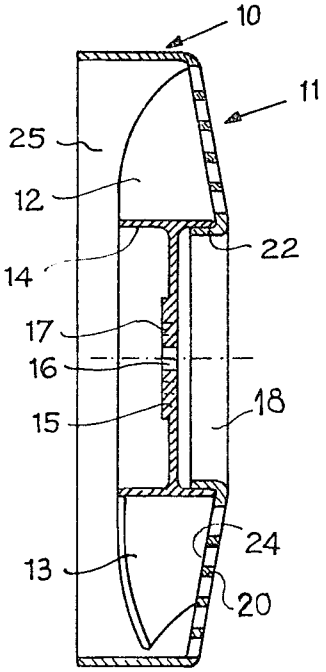
FIG. 2 is a diametrical section A—A of the preceding figure.

In the embodiment shown in FIGS. 1 and 2 the ventilator according to the invention comprises a hub 15 which carries blades 12, 13 and a protection device having a frontal protective grille 11, formed of a plurality of concentric rings 20 which are interconnected by holding members 21. Said grille 11 is provided at its periphery with an annular casing 10 for radial protection, formed of a cylindrical wall which is coaxial with the rings 20. The holding members 21 can be formed as extensions of said annular casing 10.

In the embodiment shown in FIG. 2 the frontal grille is provided with a central aperture, the edge 22 of which is bent in such a manner as to be substantially parallel to the annular casing 10. This edge 22 which is intended for fixing the protection device on the hub 15 of the ventilator can be introduced into a hollow portion 18 of the free end of the hub 15 which comprises a central hole 16 for the passage of a motor shaft (not shown) of the ventilator, with holes 17 allowing the fixing of the hub 15 to the shaft. The fastening of the protection device on the hub 15 can be carried out by using said holes in connection with rivets, screws or any other fastening means. After fixing said protection device onto the hub 15, it can turn at the same speed as the hub 15. The cylindrical wall of the annular casing 10 is coaxially disposed around the blades 12 and 13 of the ventilator, with its axis coinciding with the axis of rotation of the motor shaft.

In the embodiment shown in FIG. 2, the interior portions of the blades 12, 13 are fixed to a cylindrical wall which is integral with the hub 15 and coaxial with said hub 15, having the form of a disk.

As a matter of fact, in this embodiment the blades 12, 13 and the hub 15 have been made of a single piece by molding of a plastic material, which fact allows the setting of a low sales price for the unit.

For the same reason, the grille 11 and the protective annular casing 10 can also be made of one piece by molding of a plastic or other material. The exterior surface of the annular casing 10 must be smooth. As a matter of fact, when the ventilator operates, the exterior objects or elements which come into contact with said annular casing 10 are pushed out or deflected and cannot in any manner touch the blades 12, 13.

Besides, the concentric rings 20 of the grille are disposed sufficiently close together to reduce the gaps between the rings 20 to a degree sufficient to prevent foreign bodies, such as the users fingers, from penetrating between the rings. Said rings 20 are partially in engagement with the upper edges 24 of the blades 12,13 in such a manner as to reinforce the structure of the grille 11 as shown in FIGS. 1 and 2.

It should be understood that the ventilator according to the invention can have any number of blades, for example 6, as shown in FIG. 1.

Figure 3:
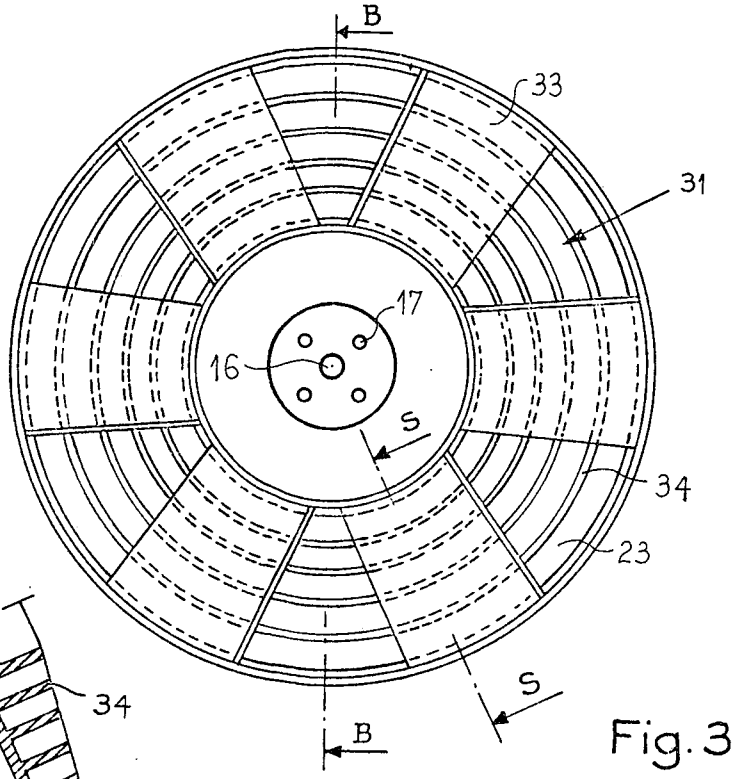
FIG. 3 shows a view in elevation of an embodiment of a unit in one block comprising an axial ventilator and its protection device according to the invention.
Figure 4:
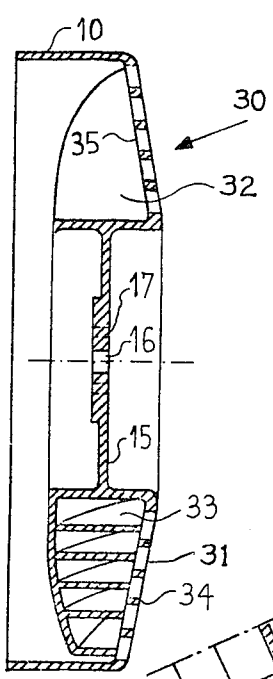
FIG. 4 is a diametrical section B—B of the unit shown in FIG. 3.
Figure 5:
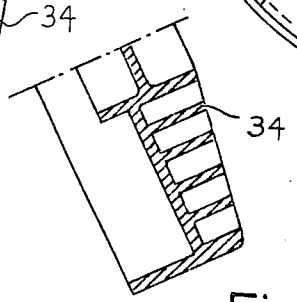
FIG. 5 is a radial section S—S of the unit shown in FIGS. 3 and 4.

In another embodiment shown in FIGS. 3, 4 and 5, the protection device 30 according to the invention which comprises a frontal grille 31 and an annular casing 10, is molded in a single piece with the hub 15 and the blades 32. The grille is formed of concentric rings 34 which are partially in engagement with the upper edge 35 of the blades 32,33. In this case the holding members of the concentric rings 34 are suppressed since they are unncessary. This embodiment which utilizes a molding in one block is particularly advantageous and allows the manufacturing of axial ventilators with frontal and radial protection which can be assembled easily in many industrial appartuses, either of the semi-industrial or the home type.

As pointed out, such ventilators can be used in refrigeration equipment whose efficiency they increase considerably.

I claim:

1. An axial ventilator comprising:

a motor shaft;

a hub mounted on said shaft;

at least two blades mounted on said hub; and a protection device comprising a protective grille fixed with respect to said blades for rotation with said blades, said grille consisting only of a plurality of concentric rings, said rings being coaxial with said shaft and being spaced from one another by gaps which are sufficiently small to prevent the passage of foreign bodies.

2. The ventilator of claim 1 wherein said foreign bodies are a users fingers.

3. The ventilator according to claim 1, wherein said protection device further comprises an annular casing at the radial outer edges of said blades, said annular casing being integral with said protective grille.

4. The ventilator according to claim 3, wherein said grille and said annular casing are molded in one piece.

5. The ventilator according to claim 3, wherein said grille is provided with a central aperture having an edge bent inwardly, parallel to a cylindrical wall of said annular casing, said protection device being fixed onto the hub by means of said edge.

6. The ventilator according to claim 5, wherein holding members which are extended portions of said annular casing connect said rings to one another and with said edge.

7. The ventilator according to claim 5, wherein said hub comprises a free end having hollow portions into which the bent edge extends and wherein means are provided for fixing said edge to the wall of the hollow portion of the hub.

8. The ventilator according to claim 3, wherein said grille, said annular casing, said blades and said hub are molded in one piece.

9. The ventilator according to claim 8, wherein said concentric rings are welded to said blades.

10. Ventilator according to any one of claims 4 or 8 or 9, wherein the molding material is a synthetic plastic material.

11. Ventilator according to claim 3, wherein said annular casing is constituted by a smooth cylindrical wall.

* * * * *